United States Patent [19]

Kannan et al.

[11] Patent Number: 4,991,780

[45] Date of Patent: Feb. 12, 1991

[54] DUOCONE SPRAY NOZZLE

[75] Inventors: Raghavachari Kannan, Newtown Square; Bernard A. Lewandowski, King of Prussia, both of Pa.

[73] Assignee: Crane Co., New York, N.Y.

[21] Appl. No.: 471,944

[22] Filed: Jan. 29, 1990

[51] Int. Cl.[5] ..... B05B 1/32; B05B 1/26

[52] U.S. Cl. ..... 239/440; 239/453; 239/459; 239/499; 239/506; 239/513; 239/516; 239/533.1

[58] Field of Search ..... 239/288–288.5, 239/439, 440, 441, 451–453, 456, 459, 460, 499, 506, 513, 514, 516, 533.1

[56] References Cited

U.S. PATENT DOCUMENTS

| | | | |
|---|---|---|---|
| 2,049,141 | 7/1936 | Schneider | 299/141 |
| 2,063,709 | 12/1936 | Taylor | 239/453 |
| 2,313,994 | 3/1943 | Grant | 299/145 |
| 3,850,373 | 11/1974 | Grolitsch | 239/499 |
| 4,197,997 | 4/1980 | Wu et al. | 239/102 |
| 4,512,520 | 4/1985 | Schoonover | 239/440 |

*Primary Examiner*—Andres Kashnikow
*Assistant Examiner*—Karen B. Merritt
*Attorney, Agent, or Firm*—Woodcock Washburn Kurtz Mackiewicz & Norris

[57] ABSTRACT

A duocone spray nozzle having two concentric peripheral orifices which will produce two hollow spray cones, one inside the other. Each orifice size is varied by employing its own spring and each spring acts independently and is compressed under its own pressure drop. The springs are designed so that the inner spring will open the inner orifice at a pressure drop which is lower than the pressure drop occurring at the outer office. Therefore, the inner spray cone occurs before the outer spray cone. When the pressure drop at the inner orifice exceeds a predetermined value, the outer orifice opens and after this occurs there will be two spray cones. A hold structure aids in separating the two spray cones.

10 Claims, 3 Drawing Sheets

FIG. 3
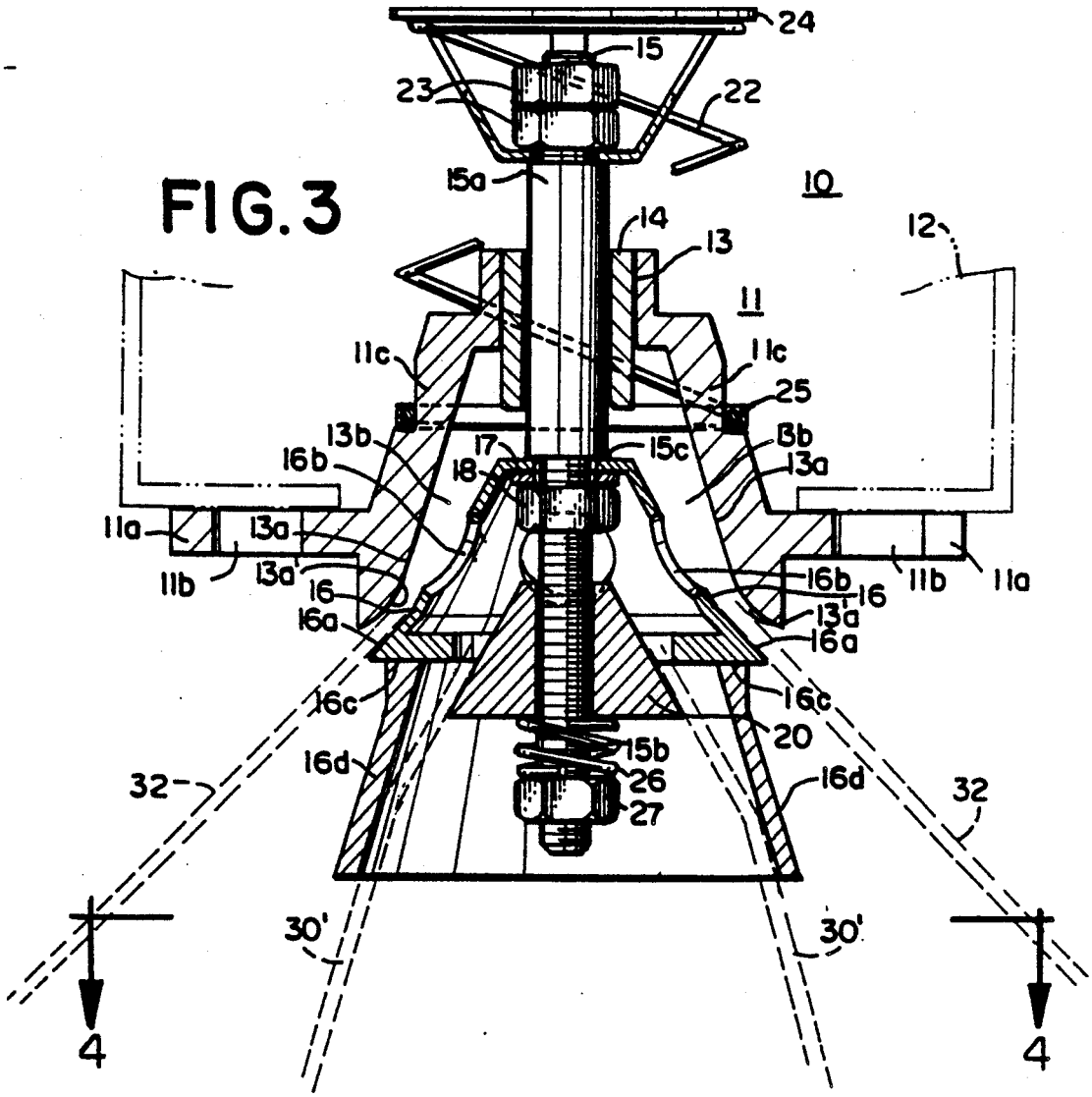
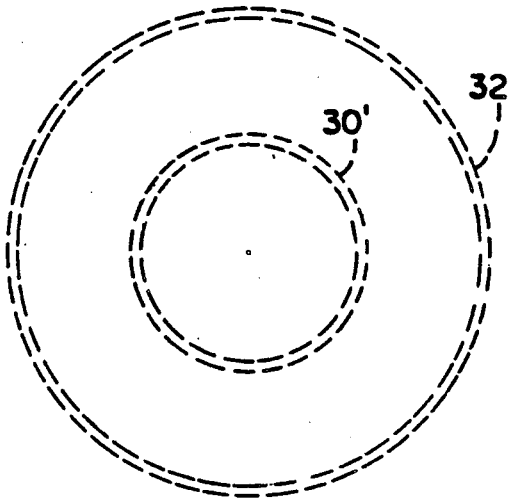
FIG. 4

DUOCONE SPRAY NOZZLE

BACKGROUND OF THE INVENTION

This invention relates to double cone spray nozzles and particularly to double cone spray nozzles where the orifices forming the individual cone sprays are variable.

Double cone spray nozzles have been utilized in many diverse applications from shower heads to fuel injector valves. An example of a multiple spray shower head is disclosed in Schneider Pat. No. 2,049,141. An example of a double cone spray nozzle for ejecting a stream in the form of a dense cloud of vapor or mist is disclosed in Grant Pat. No. 2,313,994 and an example of a floating ring fuel injector valve capable of providing outer and inner conical spray patterns emerging from the nozzle is disclosed in Wu et al Pat. No. 4,197,997.

The present invention is particularly suited for use as a nozzle in the operation of deaerators, where steam is used to heat the water which is sprayed by the nozzle. In the current practice, where water is to be distributed in the form of a thin and uniform spray, a nozzle with a spring is employed to create a single spray. The spring will create a pressure drop in the water line. The higher the pressure drop, the larger will be the flow.

The spray will be efficient only if an optimum pressure drop is created by the spring. This predetermined pressure drop can occur only when a predetermined quantity of water tries to pass through the nozzle.

If the flow happens to be less than this predetermined quantity, then the pressure drop also will be less. Under this "low flow" condition, nevertheless a spray will be formed; but, it will be non-uniform and discontinuous. This poor spray pattern will result in inefficient heat transfer.

In the duocone spray nozzle of the present invention, the inner spray will come into play at "low flow" condition. Further, at high flow, both the sprays will be distributing water. Thus, for the same pressure drop, the duocone spray nozzle will handle a greater quantity of water than the conventional single spray nozzle. The duocone nozzle also will offer more spray cone surface areas. By increasing the surface area, the capacity as well as the efficiency of heat transfer can be increased. This will result in a reduction in the size of the vessel and hence the cost of the unit. Thus it will be seen that the duocone spray nozzle will be efficient both under "low flow" and "high flow" conditions. At high flow conditions, the capacity also will be increased.

A double cone spray nozzle of the present invention is applicable for use in other applications such as packed columns where air is blown from below and when the air passes through the spray it will carry away some volatile matter. Other applications include those where a gas or vapor such as air, steam and the like has to come into intimate contact with a spray of liquid.

SUMMARY OF THE INVENTION

According to the present invention there is provided a double cone spray nozzle having a nozzle housing with a bore extending therethrough, the bore having a frustoconical section at the discharge end thereof and the nozzle having openings in the walls thereof for entry of liquid into the frustoconical section of the bore. A valve stem extends through the bore of the nozzle housing, the valve stem having a first portion supported for reciprocation at one end of the bore and the valve stem having a second portion extending through the frustoconical section of the bore. An outer spreader having a frustoconical outer surface is carried by the second portion of the valve stem and positioned within the frustoconical section of the bore, the outer spreader having openings in the walls thereof for receiving liquid from the frustoconical section of the bore. The spray nozzle further includes means for securing the outer spreader to the second portion of the valve stem, the outer frustoconical section of the outer spreader cooperating with the frustoconical section of the bore to provide an outer orifice at the discharge end for the production of an outer cone spray. An inner spreader is slidably carried by the second portion of the valve stem, the inner spreader having a frustoconical outer surface extending into the outer spreader and cooperating with structure on the outer spreader for forming an inner orifice therebetween for the production of an inner cone spray. Outer spring means is connected between the valve stem and the nozzle housing for biasing the outer orifice in a closed position. An inner spring means is connected between the valve stem and the inner spreader for biasing the inner orifice in a closed position whereby when liquid enters into the spray nozzle the liquid tries to pass through both the outer and inner orifices to produce a double cone spray and the openings of the orifices are variable as determined by the respective pressures of the inner and outer spring means.

In accordance with a further aspect of the invention the pressure of the inner spring means in biasing the inner orifice in a closed position is less than the pressure of the outer spring means for biasing the outer orifice in a closed position whereby the inner orifice will open first and produce an inner cone spray prior to opening of the outer orifice for the production of a double cone spray.

In accordance with a further aspect of the invention means is provided to aid in separating the inner cone spray from the outer cone spray.

It is a further object of the invention to provide a double cone spray nozzle which is inexpensive to manufacture. All of the hardwares of the novel double cone nozzle are inexpensive to manufacture. The valve stem is the only part to be machined and all other parts can be cast or pressed. The springs can be mass produced by winding. Since there are no fine dimensions or tolerances to be maintained the total production cost for the nozzle will be reduced. Further objects and advantages of the invention will become apparent from reference to the following description taken in conjunction with the accompanying drawings.

BRIEF DESCRIPTION OF THE DRAWINGS

FIG. 3 is a side elevational view of the embodiment shown in FIG. 1 with the valve in open position showing both the inner and outer cone sprays.

FIG. 4 is a schematic plan view on reduced scale of the double cone spray pattern taken along the line 4—4 in FIG. 3.

DETAILED DESCRIPTION OF THE PREFERRED EMBODIMENT

Figure 1:
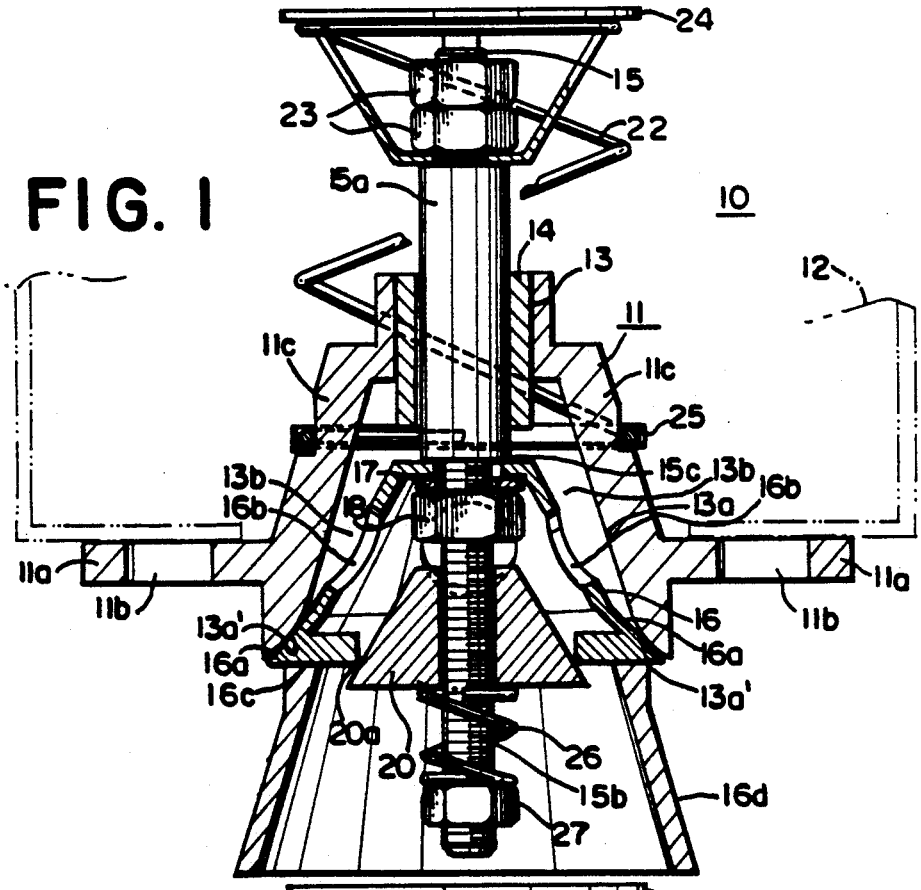
FIG. 1 is a sectional side elevational view of an embodiment of the invention with the valve in closed position.

Referring to FIG. 1 the dual cone spray nozzle 10 of the present invention has been illustrated in closed position. The spray nozzle 10 includes a nozzle body or housing 11 adapted to be mounted on the bottom of a liquid container 12. The nozzle housing 11 may be provided with a flange 11*a* and suitable bolt holes 11*b* for ease in mounting the nozzle on the container 12. It is to be understood that other types of mounting structure may be employed and the mounting structure does not form part of the present invention.

The nozzle housing 11 has a bore 13 extending therethrough and the bore 13 includes a frustoconical section 13*a* at the discharge end thereof. The nozzle housing 11 also includes a plurality of openings 13*b*, best seen in FIG. 5, in the side walls thereof which comprise a plurality of ribs 11*c* for entry of liquid from the liquid container 12 into the frustoconical section 13*a* of the bore. The upper end of the bore 13 is provided with a bearing 14 for a valve stem 15. The bearing 14 has been illustrated in the form of a bushing and may be made of any suitable material, one example of which is a Teflon bushing. The valve stem 15 extends through the bore 13 of the nozzle housing and is provided with a first portion 15*a* supported for reciprocation within the bearing 14. The valve stem 15 includes a second portion 15*b* which extends through the frustoconical section 13*a* of the bore. An outer spreader 16 having a frustoconical outer surface 16*a* is carried by the second portion 15*b* of the valve stem 15 and is positioned within the frustoconical section 13*a* of the bore. The outer spreader 16 is provided with openings 16*b* in the walls thereof for receiving liquid from the frustoconical section 13*a* of the bore. As may be seen in FIG. 1 the first portion 15*a* of the valve stem 15 has a larger diameter than the second portion 15*b* and the two portions 15*a* and 15*b* are separated from each other by a shoulder 15*c*. The outer spreader 16 is secured to the valve stem 15 by means of a nut 17 and washer 18. The nut 17 is threadedly carried by the second portion 15*b* of the stem 15 and is adapted to force the upper end of the outer spreader 16 against the shoulder 15*c* of the valve stem 15. The outer frustoconical surface 16*a* of the outer spreader 16 cooperates at its lower end with the lower end 13*a*′ of the frustoconical section of the bore 13*a* to provide an outer orifice at the discharge end of the nozzle for the production of an outer cone spray.

An inner spreader 20 is slidably carried by the second portion 15*b* of the valve stem 15. The inner spreader 20 has a frustoconical outer surface 20*a* which extends into the lower end of the outer spreader 16 and cooperates with shoulder structure 16*c* on the outer spreader 16 for forming an inner orifice therebetween for the production of an inner cone spray. It will be noted that the outer spreader 16 as provided at its lower end with a hood 16*d* of frustoconical shape which aids in separating the two cone sprays to prevent them from merging. This will further be described in connection with FIGS. 2 and 3.

An outer coil spring 22 is connected between the valve stem 15 and the nozzle housing 11 for biasing the outer orifice in a closed position. As may be seen in FIG. 1 the upper end of the valve stem 15 is threaded and adapted to receive a pair of nuts 23 for securing an upper spring retainer 24 to the upper end of the valve stem 15. The upper end of the spring 22 engages the upper spring retainer 24 and the lower end of the spring 22 engages a lower spring retainer ring 25 positioned in a groove in the outer surface of the nozzle housing 11. Since the outer spreader 16 is carried by the valve stem 15 the pressure exerted on the valve stem 15 by the spring 22 will control the pressure at which the outer orifice is opened.

An inner spring 26 is connected between the valve stem 15 and the inner spreader 20 for biasing the inner orifice in a closed position. As may be see in FIG. 1 the inner spring 26 is positioned on the lower end of the second portion 15*b* of the valve stem 15. The upper end of the spring 26 engages the lower end of the inner spreader 20 and the lower end of the spring 26 engages a nut 27 threadedly carried by the lower end of the valve stem portion 15*b*. The pressure exerted on the inner spreader 20 by the spring 26 can be adjusted by adjusting the position of the nut 27 along the threaded portion of the valve stem 15*b*.

Figure 2:
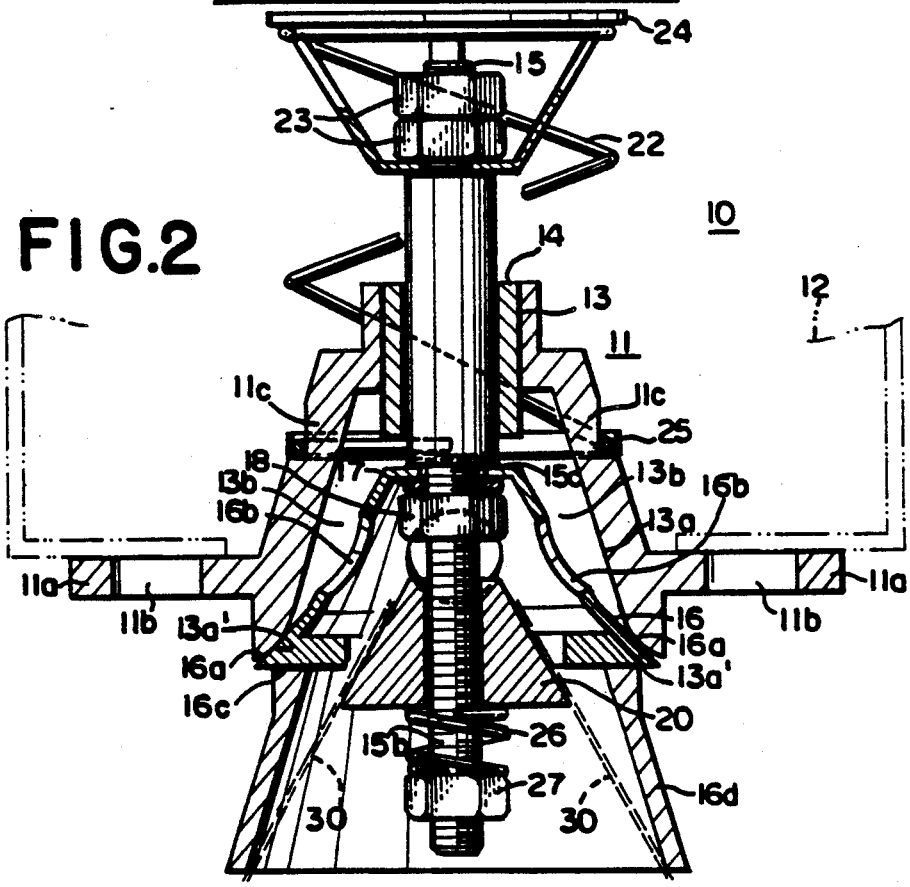
FIG. 2 is a sectional side elevational view of the embodiment shown in FIG. 1 with the valve in open position with respect to the inner cone spray.

As may be seen in FIG. 1 when the liquid from the liquid container 12 enters into the housing 11 of the spray nozzle 10 the liquid tries to pass through both the outer and inner orifices to produce a double cone spray and the openings of the orifices are variable as determined by the respective pressures of the inner and outer springs 26 and 22 respectively. Where the pressure of the inner spring 26 in biasing the inner orifice in a closed position is less than the pressure of the outer spring 22 for biasing the outer orifice in a closed position, the inner orifice between surface 20*a* and shoulder 16*c* will open first and produce an inner cone spray 30 prior to opening of the outer orifice for production of a double cone spray. This is illustrated in FIG. 2. When the pressure is low and the flow is low the inner spray cone 30 occurs alone and the spray is contained well inside the hood 16*d*. When the pressure of the liquid exerted on the outer spreader 16 exceeds the pressure of the outer spring 22 as well as the inner spring 26 then the outer orifice between surface 16*a* and surface 13*a*′ will open and produce the outer cone spray 32 of the double cone spray as shown in FIG. 3. At the higher pressure flow the inner spray 30′ tends to diverge outwardly as shown in FIG. 3 and the outer spray 32 tends to converge inwardly. In the absence of the hood 16*d* the two sprays would merge together thereby defeating an important feature of the present invention of providing a double cone spray nozzle. When the flow has increased, the inner spray 30′ diverges outwardly and now it starts striking the inside wall of the hood 16*d*. However, the hood 16*d* diverts the spray 30′ inwardly as shown in FIG. 3 thus maintaining the inner spray cone 30′ separated from the outer spray cone 32 and prevents the two cone sprays 30′ and 32 from merging. From the foregoing it will be seen that when the pressure drop at the inner orifice 20*a*–16*c* exceeds a predetermined value as set by the outer spring 22, the outer orifice 16*a*–13*a*′ will open and thereafter there will be two spray cones 30′ and 32 as illustrated in FIG. 3. The cross section of the two spray cones 30′ and 32 is illustrated schematically on reduced scale in FIG. 4.

Figure 5:
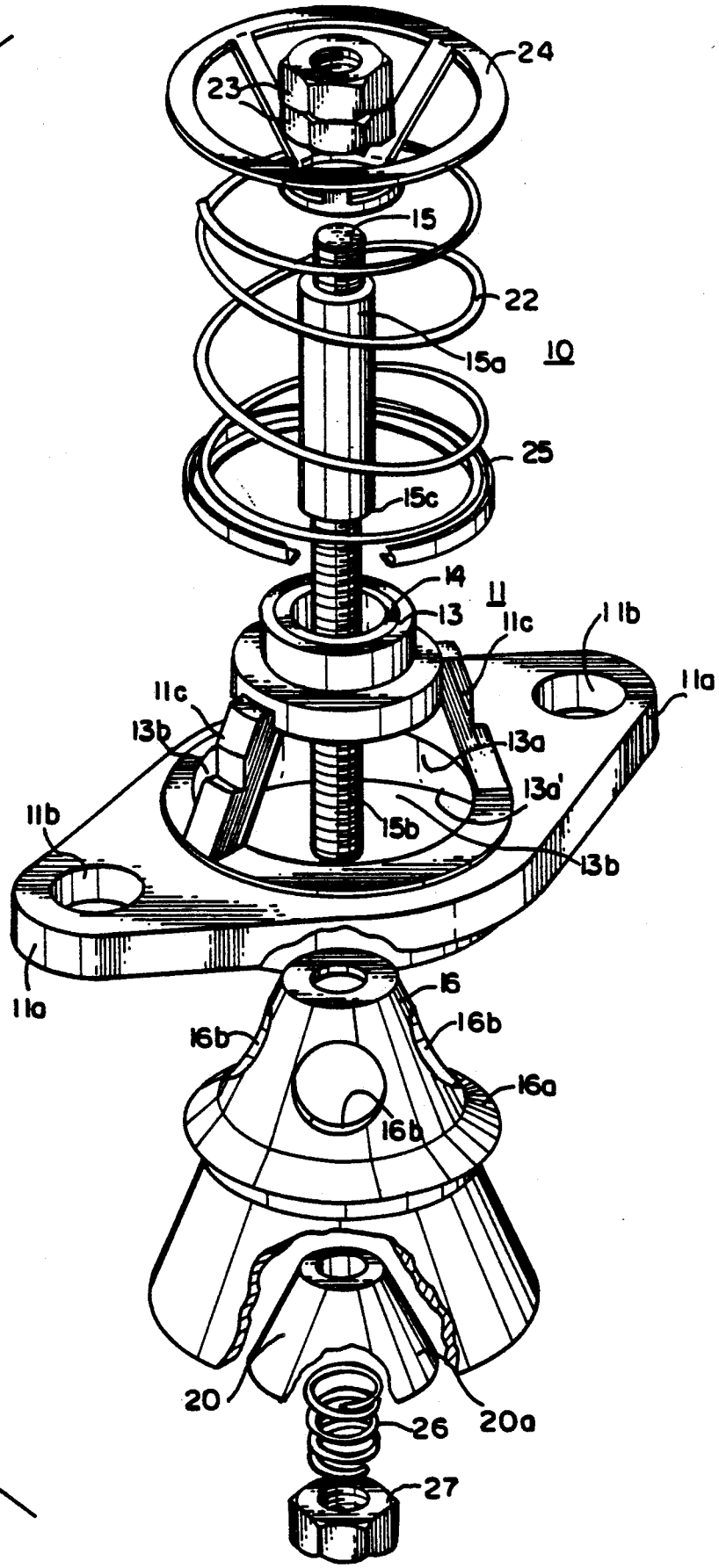
FIG. 5 is an exploded view of the valve shown in FIG. 1.

Referring to FIG. 5 the various parts of the double cone spray nozzle 10 are illustrated in exploded form and in three dimensional shape.

The dual cone spray nozzle of the present invention has numerous advantages. For the same pressure drop, the capacity of the nozzle can be increased. In heat transfer applications such for example as in deaerators, the two spray cones will offer more contact surface between the liquid and heating medium which will result in more efficient heat transfer. The two spray cones will distribute the liquid more uniformly than a single cone. For low flow conditions the dual cone spray nozzle will be more efficient.

While there has been described and illustrated a preferred embodiment of the invention, it will be understood that further modifications may be made without departing from the spirit and scope of the invention as set forth in the appended claims.

What is claimed is:

1. A double cone spray nozzle comprising:

a nozzle housing having a bore extending therethrough, said bore having a frustoconical section at the discharge end thereof, said nozzle housing having openings in the walls thereof for entry of liquid into said frustoconical section of said bore;

a valve stem extending through said bore of said nozzle housing, said valve stem having a first portion supported for reciprocation at one end of said bore and said valve stem having a second portion extending through said frustoconical section of said bore;

an outer spreader having a frustoconical outer surface carried by said second portion of said valve stem and positioned within said frustoconical section of said bore, said outer spreader having openings in the walls thereof for receiving liquid from said frustoconical section of said bore, means for securing said outer spreader to said second portion of said valve stem, the outer frustoconical surface of said outer spreader cooperating with the frustconical section of said bore to provide an outer orifice at the discharge end for the production of an outer cone spray;

an inner spreader slidably carried by said second portion of said valve stem, said inner spreader having a frustoconical outer surface extending into said outer spreader and cooperating with structure on said outer spreader for forming an inner orifice therebetween for the production of an inner cone spray;

outer spring means connected between said valve stem and said nozzle housing for biasing said outer orifice in a closed position; and inner spring means connected between said valve stem and said inner spreader for biasing said inner orifice in a closed position, whereby when liquid enters into the spray nozzle the liquid tries to pass through both the outer and inner orifices to produce a double cone spray and the openings of said orifices are variable as determined by the respective pressures of said inner and outer spring means.

2. A double cone spray nozzle according to claim 1 including means for separating the inner core spray from the outer cone spray.

3. A double cone spray nozzle according to claim 2 wherein said means for separating the inner cone spray from the outer cone spray comprises a frustoconical hood depending from said outer spreader.

4. A double cone spray nozzle according to claim 2 wherein the pressure of said inner spring means in biasing said inner orifice in a closed position is less than the pressure of said outer spring means for biasing said outer orifice in a closed position whereby said inner orifice will open first and produce an inner cone spray prior to opening of said outer orifice for the production of a double cone spray.

5. A double cone spray nozzle according to claim 2 wherein said bore of said nozzle housing includes bearing means supporting said first portion of said valve stem for reciprocation.

6. A double cone spray nozzle according to claim 2 wherein said second portion of said valve stem includes a threaded section for cooperation with said means for securing said outer spreader to said second portion of said valve stem.

7. A double cone spray nozzle according to claim 2 wherein said outer spring means comprises a coil spring surrounding said first portion of said valve stem, one end of the coil spring being connected with said first portion of said valve stem and the other end of said coil spring being connected with the outer surface of said nozzle housing.

8. A double cone spray nozzle according to claim 2 wherein said inner spring means comprises an inner coil spring positioned on said second portion of said valve stem, one end of said inner coil spring being connected with said inner spreader and the outer end of said inner coil spring being connected with said second portion of said valve stem.

9. A double cone spray nozzle according to claim 8 wherein said end of said inner coil spring connected to said second portion of said valve stem is adjustably connected to vary the pressure of said inner coil spring with respect to said inner spreader.

10. A double cone spray nozzle according to claim 2 where said first portion of said valve stem has a larger diameter than said second portion of said valve stem to provide a shoulder therebetween, said second portion of said valve stem being threaded, and said means for securing said outer spreader to said second portion of said valve stem comprises threaded means adjustable longitudinally of said second portion of said valve stem for securing said outer spreader against said shoulder on said valve stem.

* * * * *